US005813918A

United States Patent [19]

Conigliaro

[11] Patent Number: 5,813,918

[45] Date of Patent: Sep. 29, 1998

[54] METHOD OF EXACTLY DUPLICATING IN A NEW BOWLING BALL, THE THUMB-HOLE OF A REFERENCE BOWLING BALL

[75] Inventor: Joseph Conigliaro, Rosedale, N.Y.

[73] Assignee: X-Act Duplicator, Inc., Richmond Hill, N.Y.

[21] Appl. No.: 743,339

[22] Filed: Nov. 4, 1996

[51] Int. Cl.[6] ..... A63B 43/02

[52] U.S. Cl. ..... 473/128; 473/130

[58] Field of Search ..... 473/127, 128, 473/129, 130; 264/DIG. 66, 36, 220, 225, 227

[56] References Cited

U.S. PATENT DOCUMENTS

| | | | |
|---|---|---|---|
| 2,460,385 | 2/1949 | Hausman | 473/130 |
| 2,712,160 | 7/1955 | Sterczek | 473/130 |
| 2,843,382 | 7/1958 | Ross | 473/129 |
| 3,858,839 | 1/1975 | Bowman | 473/130 |
| 5,123,644 | 6/1992 | Bernhardt | 473/130 |

*Primary Examiner*—William M. Pierce
*Attorney, Agent, or Firm*—Oliveras & Counsel; M. G. Marinangeli, Esq.

[57] ABSTRACT

A improved, and simplified method of producing a finger or thumb hole (gripping hole) copied from an existing reference hole in a bowling ball. The essential improvement in this invention being an improved method of replicating a reference hole of a bowling ball with ease and relative cost efficiency and to have the ability to change the orientation of the new hole in pitch and distance. A silicone mold taken of the reference hole allows a urethane sleave to be created that features a duplicative a) length of the reference hole; b) texture of the inner portion of the reference hole; c) bevel at the top of the reference hole; and d) shape of the reference hole so that these dimensions can be copied immediately, or at a later date, onto a new ball. A variety of hole sizes (eg. 1⅛, 1¼, 1⅜ inches) can also be used to remedy any change or correction in the finger size. Once the duplicative silicone mold is made of the reference ball's gripping hole, a replicative urethane sleeve is produced in the form of a plastic cylinder, no longer requiring the reference bowling ball.

2 Claims, 3 Drawing Sheets

METHOD OF EXACTLY DUPLICATING IN A NEW BOWLING BALL, THE THUMB-HOLE OF A REFERENCE BOWLING BALL

FIELD OF THE INVENTION

The present invention relates to a method for copying the size, shape, and contours of a bowler's fingers for duplication on additional bowling balls. More specifically, the present invention discloses an improved and simplified method of producing a thumb hole (gripping hole) copied from an existing reference hole in a bowling ball.

Bowling bowls have heretofore been drilled to form finger grips for the bowler, the finger holes being sized and spaced to receive the thumb, middle finger and ring finger of the bowler and to comfortably fit the spread of the bowler's fingers. The balls many times are not drilled for the hand of a particular bowler and where the bowler does not have his own ball, he will select a ball in which the hole size and spread approximates the hand of the bowler. It is, however, difficult to obtain the exact fit, even where the ball is drilled for the fingers of the bowler and the finger holes are frequently too tight or to loose and are cylindrical throughout their length and do not provide sufficient gripping surface to give the average bowler the required control of the ball.

The essential improvement in this invention being an improved method of replicating a thumb-hole with ease and relative cost efficiency and to have the ability to change the orientation of the hole in pitch and distance. A mold taken of the reference thumb-hole allows the sleeve to be recreated and features a duplicative a) length of the hole, b) texture of the inner portion of the hole, c) bevel at the top of the hole, and d) shape of the hole so that these dimensions can be copied immediately, or at a later date, onto a new ball. A variety of hole sizes (eg. 1⅛, 1¼, 1⅜ etc,) can also be used to remedy any change or correction in a bowler's finger size. Once a duplicative silicone mold is made of the reference ball's gripping hole, a replicative urethane sleeve is produced in the form of a plastic cylinder or mold, no longer requiring the reference bowling ball.

DESCRIPTION OF THE PRIOR ART

The sport of bowling is a major sports and pastime played by millions of people around the United States and abroad. In bowling it is the object of the bowler to knock down as many pins as possible with a bowling ball. The invention described herein is concerned with the bowling ball, which is a large and heavy object, and having a diameter that makes it virtually impossible to be safely handled with one hand. In order to propel the ball with one hand, holes are drilled into the ball for insertion of the fingers of the bowler's preferred hand. Most often, three such holes, for a thumb and two fingers, are precisely drilled, defining a triangle on the surface of the ball. Using them, the bowler can propel the ball down the bowling alley in a fluid, one-handed motion toward the bowling pins. The diameters of the drilled holes should be designed to particularly accommodate the individual bowler's finger and hand contours. Since each person has differing finger sizes, bowling balls are typically custom fit for optimum efficiency. This presents a less than ideal solution because the owner of the ball will find that his fingers will not always fit the holes as well as he might like, due to changes in finger size from swelling, injury, or weight gain or loss. Moreover, other people will not be able to use that same ball as the holes will be the wrong size for their particular fingers. Finger holes are typically drilled in increments of 1/32 inch, and since human fingers are not formed in 11/32 inch increments, this presents an undesirable compromise.

This situation is most acute for the novice bowler who, typically, does not own a ball, but "borrows" one from the bowling alley. The novice must search through of the many "loaners" available at the establishment to hopefully find one that gives the best fit. Compromise in this situation is unavoidable.

Further, since the bowling ball is by necessity made from a hard material, frequent bowling often results in sore fingers, chafing, or even blisters and calluses. Particularly strong bowler's, known in the vernacular as "crankers" commonly release the ball with a severe rotation of the wrist and fingers to impart spin to the ball and create a curved path for the ball to impact the pins. This type of ball release requires the user's fingers to withstand a significant amount of side pressure, creating fatigue and discomfort. Prior art solutions have attempted to solve these problems by providing many types of finger hole inserts for bowling balls.

One solution is posed in U.S. Pat. No. 4,289,312 which discloses a finger hole insert made from resilient vinyl. During the delivery of the ball, the insert is said to compress under the bowler's finger pressure. However, those skilled in the art will appreciate that elastomers such as vinyls and rubbers do not compress, but merely displace, and inserts of this type have minimal, if any compliance to accommodate varying finger sizes. Other prior art patents that are illustrative of the state of the art of finger inserts for bowling balls and methods of making same as of July 1996, are disclosed in the following U.S. Pat. Nos. 5,330,392; 5,308,061; 5,023,988; 5,007,640; 4,773,645; 4,699,380; 4,585,230; 4,569,520; 4,530,502; 4,247,102; 4,191,357; 3,858,839; 3,711,231; 3,521,506; 3,454,440; 3,386,176; 3,316,588; 2,843,382; and 2,712,160. The variety of ideas found in these patents attest to the need for a solution to the problem. Most bowler's today continue to suffer from poor finger fit, and as a consequence, compromise the optimum situation.

The disclosures in the above references taken alone or in combination neither anticipate nor render obvious the present invention. Although considered new and useful at the time they were proposed and patented or publicly disclosed, none of these prior arts discloses a method of copying the particular contours of any person's fingers to the shape and angle of a particular reference bowling ball. Even a person whose thumb or finger sizes have changed since the making of a reference bowling ball can comfortably fit into the duplicative holes made in a new bowling ball by the new method disclosed herein. Accordingly, the present inventor's goal is of providing for a new method for exactly duplicating the shape, size, bevel and inner contour of a reference bowling ball thumb-hole for use in new bowling balls.

OBJECTS OF THE INVENTION

It is accordingly a primary object of the present invention to provide an improved method for duplicating the thumb-hole of a bowling ball without the use of any cumbersome equipment.

The present invention thus provides, as a major object, a method for producing a thumb-hole in a new ball which is identical to the thumb-hole existing in a reference or used bowling ball.

The present invention provides, as another important object, a method, of duplicating in a new bowling ball the exact size, shape, direction, bevel and span of the thumb hole in an existing bowling ball. In this manner, a bowler, having a reference bowling ball with properly fitting finger and thumb holes, can readily obtain another bowling ball with matching finger and thumb holes.

The present invention provides, as a further object, a simple method of duplicating the thumb-hole of a bowling ball with ease and economy.

Another object of the present invention is to provide a method of duplicating a bowling ball thumb-hole that does not require the presence of the reference ball at the time of duplication or the use of any heavy, cumbersome and costly equipment.

A further object of the present invention is to provide a method of duplicating a bowling ball hole wherein the length, texture, bevel, size contour and shape are exactly replicated.

Another object of the present invention is to provide a method of duplicating a bowling ball hole and having the possibility to change the orientation of the hole in pitch and/or distance.

Still a further object of the present invention is to improve any deficiencies in known in prior methods.

Other objects, advantages and novel features of the invention will become readily apparent to those skilled in the art from the following detailed description of the invention when considered in conjunction with the attached drawings wherein like reference numbers identify like parts throughout.

DETAILED DESCRIPTION OF THE INVENTION IN A PREFERRED EMBODIMENT

Figure 1:
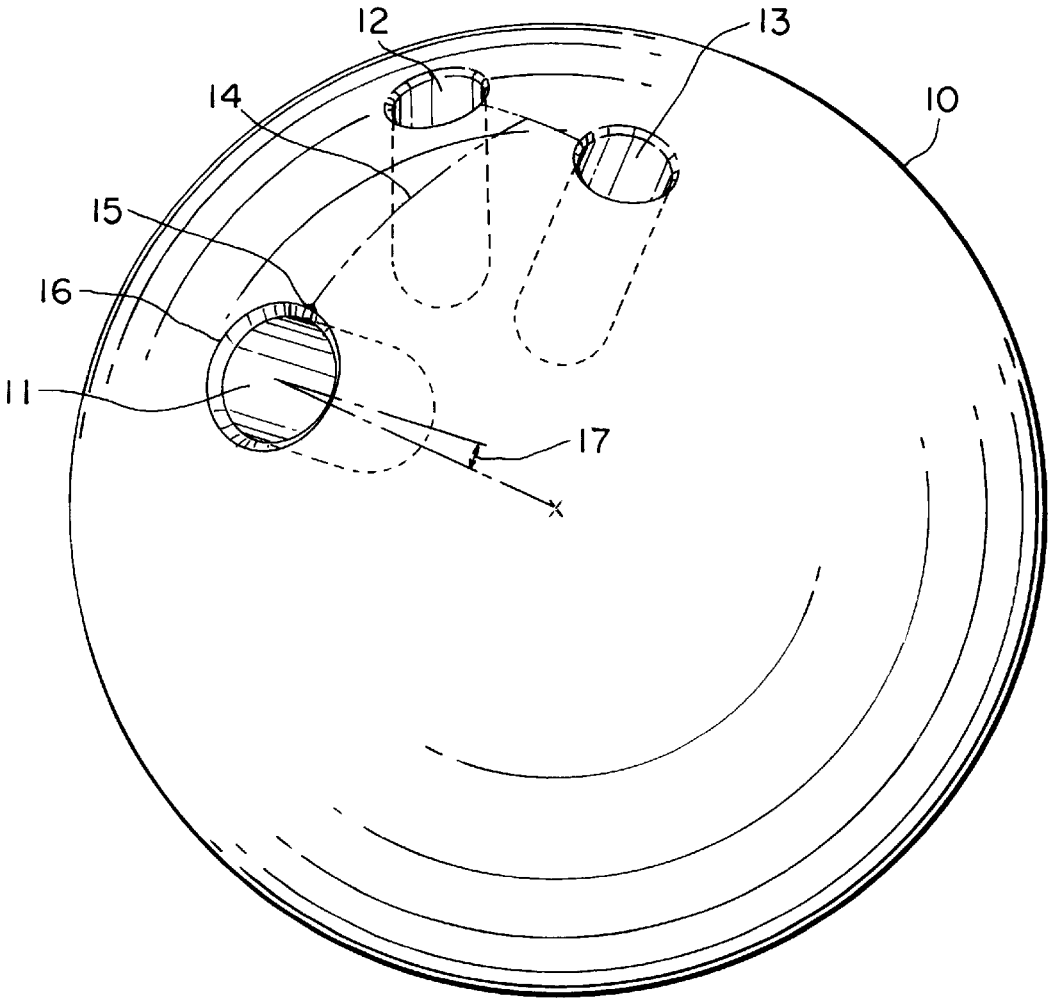
FIG. 1 is a generally isometric view of a reference bowling ball having thumb and finger inserts to be duplicated in a new ball.

Referring now more specifically to the drawings, FIG. 1 illustrates in an isometric view, a reference bowling ball 10 having a thumb-hole 11, and finger holes 12 and 13. The first stage in duplicating the thumb-hole 11 of reference ball 10 is to prepare a silicone insert mold 23 of the thumb-hole 11. Using the reference ball 10, one draws a center-line, designated as number 14 in FIG. 1, that splits the bridge between the finger holes 12 and 13 and through the center of the thumb-hole 11. Next, an alignment mark or small notch 15 is made at the point where the centerline 14 makes contact with the bevel 16 at the front of the thumb-hole 11. The pitch angle 17 of the thumb-hole 11 of the reference ball 10 is recorded for accuracy in the molding procedure.

Figure 2:
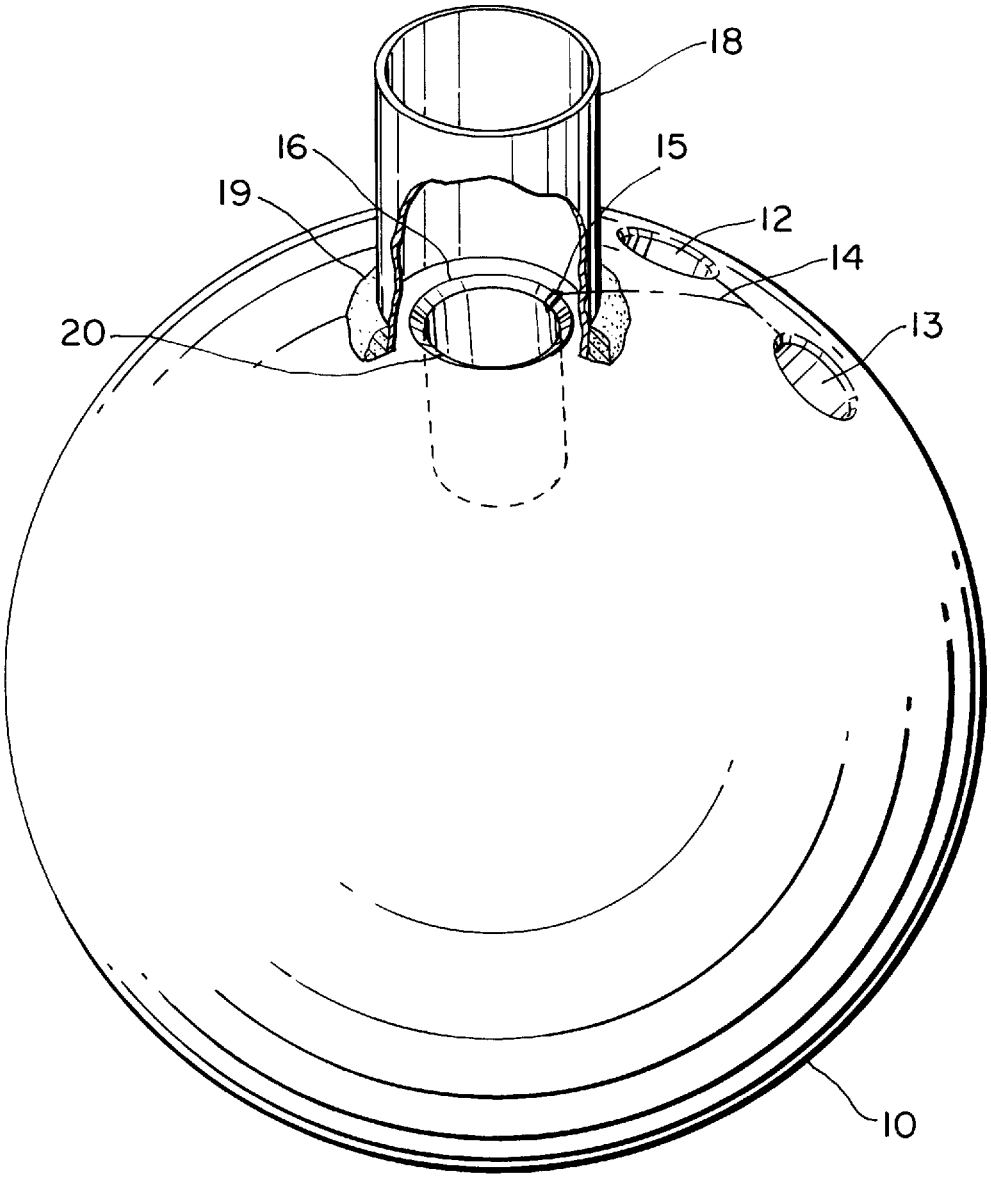
FIG. 2 is an isometric view of the reference bowling ball of FIG. 1 wherein a first tubular cylinder is disposed over the opening of the thumb-hole.

As shown in FIG. 2, a first tubular cylinder 18, having a circumference that is larger than the thumb-hole 11 to be molded, is then is then centered around said thumb-hole 11 so that said thumb-hole can be exactly duplicated. Next, a portion of clay 19 is pressed around the outside of the first tubular cylinder 18 in order to keep said cylinder 18 resting firmly over the opening 20 and bevel 16 of thumb-hole 11.

Figure 3:
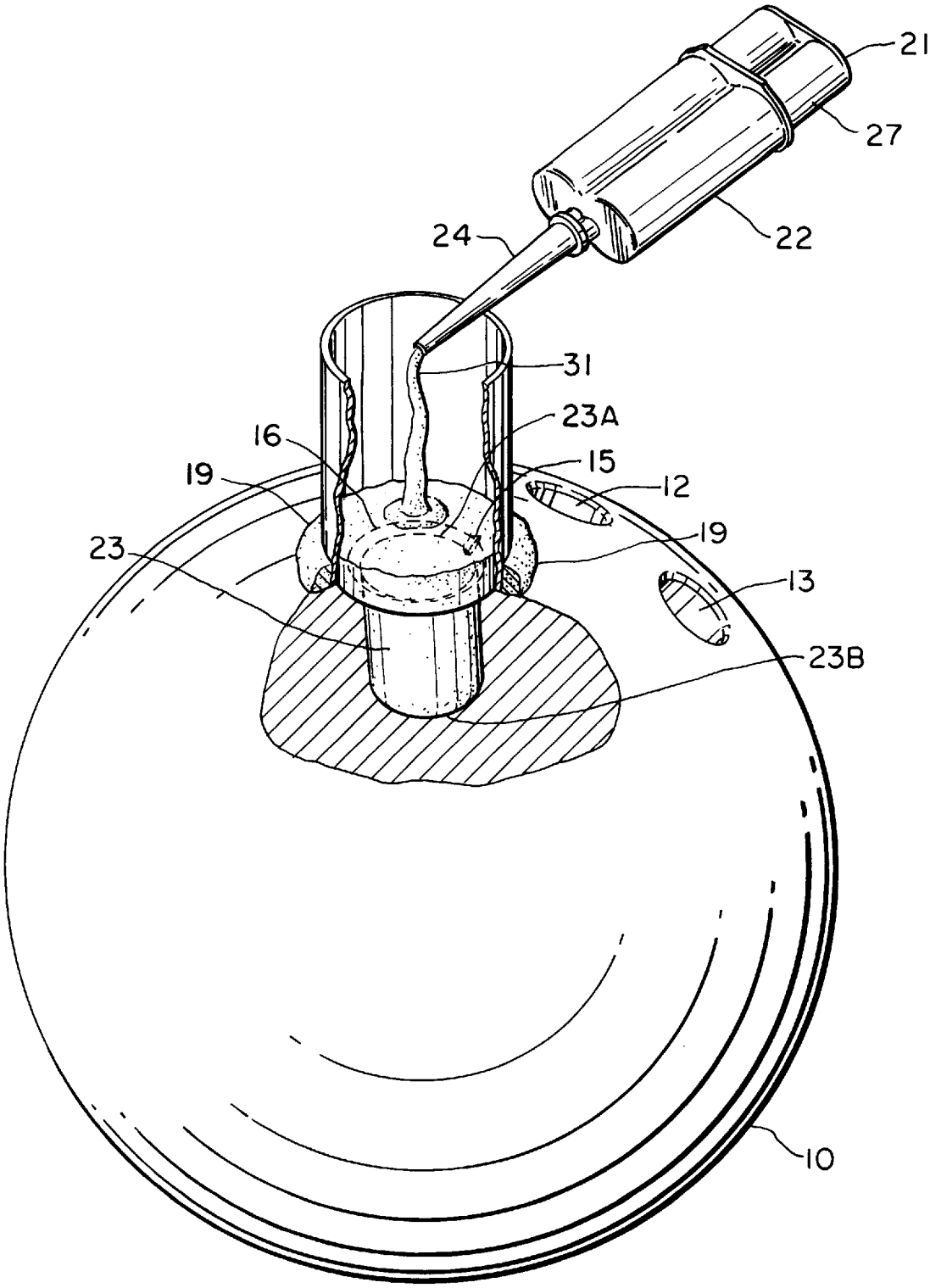
FIG. 3 is an isometric view of the reference bowling ball of FIG. 1 wherein a silicone dispensing gun is shown dispensing silicone into the first tubular cylinder and into the opening of the thumb-hole.

FIG. 3 shows a silicone dispensing gun 21 having two silicone cartridges 22, a handle 27, and a mixing tip 24. In the next duplicating stage, as disclosed in preferred embodiment disclosed herein, the silicone dispensing gun 21, having said mixing tip 24 contains the silicone material 31 that will make a silicone mold 23 (see FIG. 4). The top 23*a* of the insert mold 23 is not to be trimmed or opened. Only the bottom 23*b* may be trimmed or opened to allow for a long thumb or thumbnail. Squeezing the gun handle 27, the rachet action will push the silicone material 31 out of the cartridges 22 and through the mixing tip 24, dispensing a quantity of silicone material 31. To assure a proper silicone mixture the first ½" of the silicone material 31 dispensed should be discarded into a waste cup. The mixing tip 24 is now positioned over the the first tubular cylinder 18 and the silicone material 31 is pushed out into it. The thumb-hole 11 of the reference bowling ball is filed with enough silicone material 31 so that it covers the bevel 16 and the notch mark 15 made therein. Within 20 minutes the silicone insert mold 23 will be cured. After curing, the clay 19 and the first tubular cylinder 18 are removed from the reference ball 10. Now the cured silicone mold 23 can be extracted from the ball 10 thumb-hole 11 with a steady slow pull. The top 23*a* of the insert mold 23 is trimmed of any excess silicone, and with a marking pen the center of the silicone mold tip is marked. An exact duplicative silicone mold 23 of the thumb-hole 11 of a reference bowling ball 10 has now been created having a notch 15 and the same inner size, shape, length, contour, and bevel.

Note, if one is only making one insert mold 23 at one time, one must keep the silicone dispensing gun 21 in an upright position until one is ready to make another duplicative silicone insert 23 using the remaining silicone material 31 from the silicone dispensing gun 21. The silicone material 31 must be kept at a temperature above 70 degrees fahrenheit. Should the temperature drop below 70 degrees fahrenheit and cause the silicone material 31 to gel, the dispensing gun 21 can be warmed to reinstate the material 31.

Figure 4:
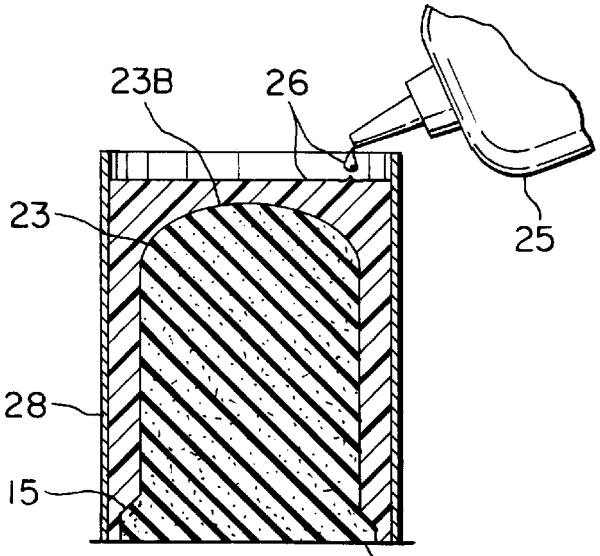
FIG. 4 is a diagrammatic view of the hardened silicone mold, removed from the thumb-hole of the reference ball, and placed into a second tubular cylinder which is then filled with urethane.
Figure 5:
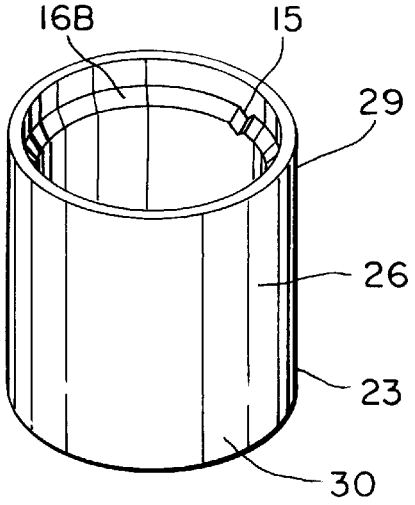
FIG. 5 is an isometric view of the hardened urethane mold which is an exact duplication of the original thumb-insert of the reference bowling ball.

The next stage in the bowling ball hole 11 duplicating procedure is to make a urethane thumb insert 28 from the cured silicone thumb-hole mold 23. First one highlights the alignment mark or small notch 15 at the front of the silicone thumb-hole mold 23 with a marking pen. As seen in FIG. 4, the silicone thumb-hole mold 23 is then inserted into a second tubular cylinder 28. The diameter of the second tubular cylinder 28 is larger than the diameter of the first tubular cylinder 18 so that the prepared silicone thumb-hole mold 23 can fit within said tubular cylinder 28. Again as shown in FIG. 4, the cured silicone thumb-hole mold 23 is inserted and centered into the second tubular cylinder 28 in an upright position. A standard urethane dispensing gun 25, having a urethane material containing cartridge 26 therein, is selected and shaken for 30 seconds. The urethane material 26 is then dispensed into the second tubular cylinder 28 thus surrounding the silicone thumb-hole mold 23 centered therein. Within 10–20 minutes, depending on the exact urethane material 26 used, the urethane material 26 will cure forming a urethane insert 29 which exactly replicates the outer and inner size, shape, length, contour, bevel and notch 15 of the silicone thumb-hole mold 23. As shown in FIG. 5, this cured urethane thumb insert 29, being removed from the second tubular cylinder 28 of FIG. 4, is now ready for installation in a new bowling ball.

Method Of Installing The Urethane Insert In A New Bowling Ball

First, the same pitch 17*a* is drilled in the new bowling ball 10*a* thumb-hole 11*a* (not shown but described using the subdesignation "a" to describe the same parts shown in FIG. 1) as the recorded pitch 17 of the reference ball 10 thumb-hole 11. Next, the depth of the new thumb-hole 11*a* is checked to determine whether to trim the bottom of the molded urethane insert 29 or whether one must drill the thumb-hole 11*a* deeper. The outer surface 30 of the urethane insert 29 is then worked a course finish using sand paper (eg. 220 grif). If needed, a test for the same pitch 17 present in the reference ball 10 is done by drilling a hole in a dummy ball and installing the urethane insert 29. A proper fit of the urethane thumb-insert 29 is a flush position of the insert 29 to the surface of the new ball 11*a*. Any known slo-zap adhesive is then applied to the inside top of the thumb-hole 11*a* in a new ball 10*a*. Notch 15 of the molded urethane insert 29 is then aligned with the drawn centerline 14*a* of the new ball 10*a*. A few minutes must be allowed for the slo-zap adhesive to dry once the insert 29 has been properly installed. Without the use of the reference ball or any cumbersome and costly duplicating equipment, a new bowling ball, having a thumb-hole hole with the exact size, shape, bevel, inner contour and length has been created of the reference thumb-hole.

Since the invention is described and illustrated with reference to but a single preferred embodiment, and since numerous modifications and changes to the exact method described and claimed herein may become readily apparent to those skilled in the art after reading this disclosure, it should be understood that I do not wish to limit the scope of my invention to the exact method described above and as claimed below.

I claim:

1. A method for duplicating an existing thumb hole in a reference bowling ball comprising the steps of:

providing a reference bowling ball having a thumb hole and finger holes seperated by a bridge, said holes having a length, texture, inner contour, bevel, size, and shape, drawing a center-line on the reference ball to be molded that splits a bridge between its finger holes and through a center point of its thumb hole, making a small notch at a point where the centerline makes contact with the bevel at a front point of the thumb hole, recording a pitch angle of the thumb hole for accuracy of the thumb hole in the reference ball being molded, centering a first tubular cylinder around the thumb hole to be molded, surrounding the first tubular cylinder with clay, dispensing silicone material into the thumb hole until it enters the first tubular cylinder and covers the bevel and the notch made therein, waiting 20 minutes until the silicone material has cured into a silicone mold of the reference ball thumb hole, removing the cured silicone mold from the reference ball thumb hole, placing the cured silicone mold into a second tubular cylinder, centering the cured silicone mold in the second tubular cylinder in an upright position so as to form a space between the silicone mold and an inside of the second tubular cylinder, dispensing urethane material into the space between the mold and second tubular cylinder, waiting 10–20 minutes until the urethane material has cured into a urethane mold which has the same the length, texture, contour, bevel, size, and shape as the inner surface of the reference ball thumb hole, removing the silicone mold from the urethane mold, installing the duplicative urethane mold into a new bowling ball hole by an installing means.

2. A method of installing a duplicative urethane mold into a new bowling ball hole comprising the steps of:

providing a bowling ball with finger holes seperated by a bridge, drilling a new thumb-hole having the same pitch angle as the recorded pitch angle of the reference bowling ball thumb-hole, checking the depth of the new thumb-hole, drawing a center-line on the new bowling ball that splits the bridge between its finger holes and through the center of the new thumb-hole, aligning the small notch at the point where the centerline makes contact with the bevel at the front of the new thumb-hole, working the outer surface of the urethane thumb insert to a course finish using sand paper, applying an adhesive at the inside top of the new thumb-hole, inserting the urethane thumb insert into the thumb-hole so that a duplicative thumb-hole is created having the same inner length, texture, contour, bevel, size and shape as the reference ball thumb-hole.

* * * * *